United States Patent [19]

Wakuda

[11] Patent Number: 5,076,129

[45] Date of Patent: Dec. 31, 1991

[54] APPARATUS FOR OPENING AND CLOSING THE COVER FOR A KEYBOARD OF A MUSICAL INSTRUMENT

[75] Inventor: Katsumi Wakuda, Hamamatsu, Japan

[73] Assignee: Kabushiki Kaisha Kawai Gakki Seisakusho, Shizuoka, Japan

[21] Appl. No.: 529,663

[22] Filed: May 29, 1990

[30] Foreign Application Priority Data

Jun. 14, 1989 [JP] Japan ..... 1-69638[U]

[51] Int. Cl.[5] ..... G10C 3/02

[52] U.S. Cl. ..... 84/179

[58] Field of Search ..... 84/177, 178, 179, 180, 84/183, DIG. 3, DIG. 17

[56] References Cited

U.S. PATENT DOCUMENTS

| | | | |
|---|---|---|---|
| 788,044 | 4/1905 | Haddorff | 84/179 |
| 4,656,913 | 4/1987 | Yoshikawa | 84/177 |
| 4,742,799 | 5/1988 | Kira et al. | 84/179 |

FOREIGN PATENT DOCUMENTS

| | | |
|---|---|---|
| 38-20518 | 10/1963 | Japan . |
| 57-150891 | 9/1982 | Japan . |
| 58-28894 | 2/1983 | Japan . |
| 62-132589 | 8/1987 | Japan . |

*Primary Examiner*—Brian W. Brown

*Attorney, Agent, or Firm*—Irving M. Weiner; Joseph P. Carrier; Robert M. Petrik

[57] ABSTRACT

An apparatus for opening and closing the cover for a keyboard of a musical instrument including a rack and pinion mechanism to provide smooth sliding of the cover member. A rack and a pinion guide groove are integrally formed on each side of the musical instrument. A rotatable shaft includes at each end a pinion which engages with the rack. The pinion members are slidingly engaged on the shaft so that the guide members at each end of the shaft may be easily inserted into the guide grooves provided on the sides of the mechanism.

6 Claims, 5 Drawing Sheets

PRIOR ART

APPARATUS FOR OPENING AND CLOSING THE COVER FOR A KEYBOARD OF A MUSICAL INSTRUMENT

BACKGROUND OF THE INVENTION

1. Field of the Invention

The present invention relates to an apparatus for opening and closing a cover for a keyboard-type musical instrument such as an electronic piano and the like. More particularly, the invention relates to a sliding cover which is easier to assemble and provides for a smoother operating device.

2. Description of the Relevant Art

Shown in FIGS. 8 through 11, a conventional apparatus including a member c having on its upper face a rack "a" and a guide groove b is fixed with screws on the inner side surface of a plate e of a musical instrument case b. Shaft g is provided at the rear portion of a sliding cover f which covers the keyboard. Pinions h are provided on both end portions of the rotary shaft g. Each end of the rotary shaft g is slidably fitted into the pair of right and left guide grooves b.

One of the major problems associated with the known cover members is the possibility that the members are longitudinally or vertically misaligned when they are fixed with screws. If this occurs, engagement between the moving members becomes uneven, and the opening and closing of the sliding cover cannot be accomplished smoothly and evenly.

The present invention overcomes the above-mentioned alignment problem by providing rack and pinion guide grooves which are always in a predetermined symmetrical position on the right and left side-plates. As a result, the engagement between the racks and the pinions is smooth and the sliding cover can be easily slid into place.

SUMMARY OF THE INVENTION

The present invention comprises an apparatus for opening and closing a sliding cover for covering a keyboard of a keyboard-type instrument.

The apparatus comprises a right side-plate and a left side-plate each including an outer side-plate member and an inner side-plate member, the inner side-plate member connected with the outer side-plate member. The inner side-plate member has integrally formed thereon a rack and a pinion guide groove.

A transversely mounted rotary shaft is provided at the rear end of the sliding cover and includes a pinion mounted respectively at the right and left end portions thereof. Each pinion mounted at the right and left end portions is engaged with the racks formed on the inner side-plate members. The shaft further includes a right and a left pinion guide members slidably fitted into the pinion guide grooves.

It is the primary object of the present invention to provide a smoothly translating cover for the keyboard of the musical instrument.

The above and further objects, details and advantages of the present invention will become apparent from the following detailed description of preferred embodiments thereof, when read in conjunction with the accompanying drawings.

DETAILED DESCRIPTION OF THE PREFERRED EMBODIMENTS

Figure 1:
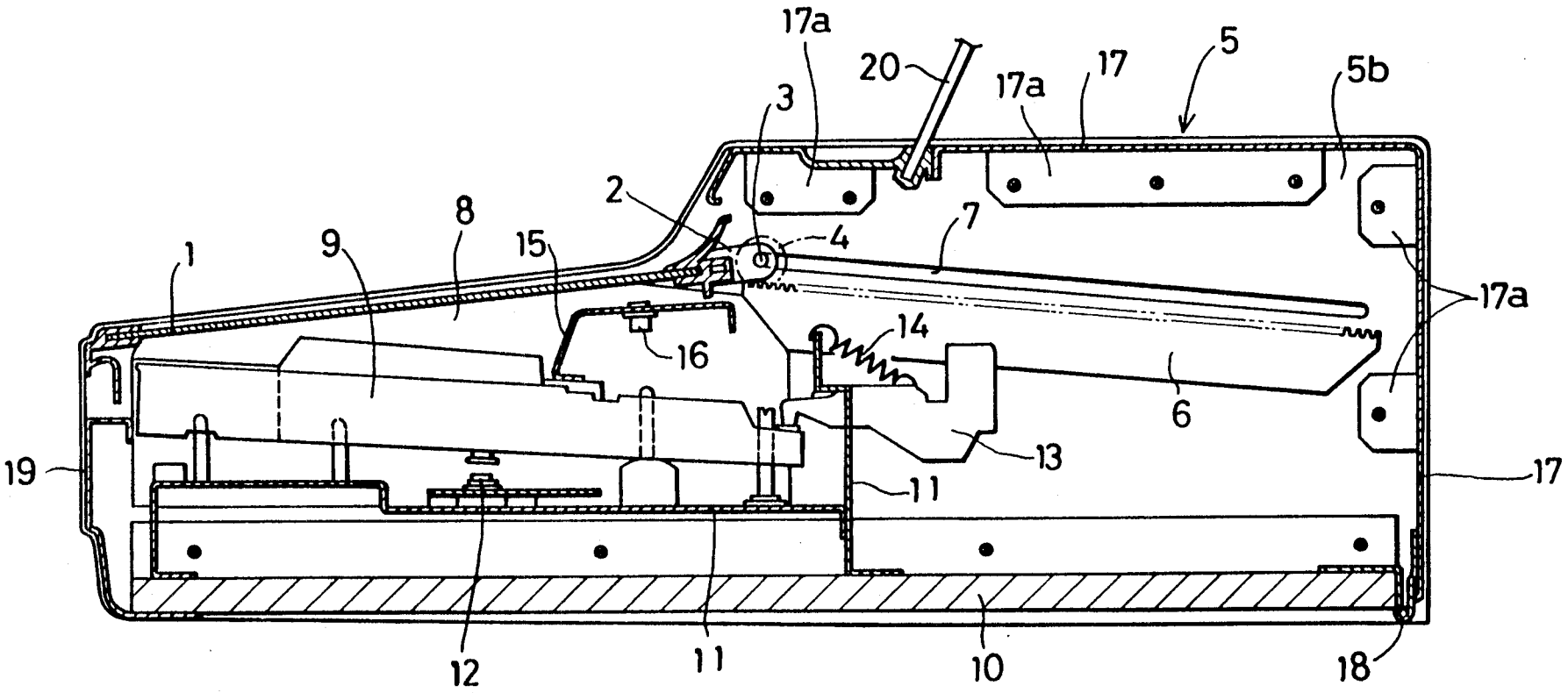
FIG. 1 illustrates a sectional side view of a keyboard-type musical instrument showing the cover closed in accordance with the present invention.
Figure 2:
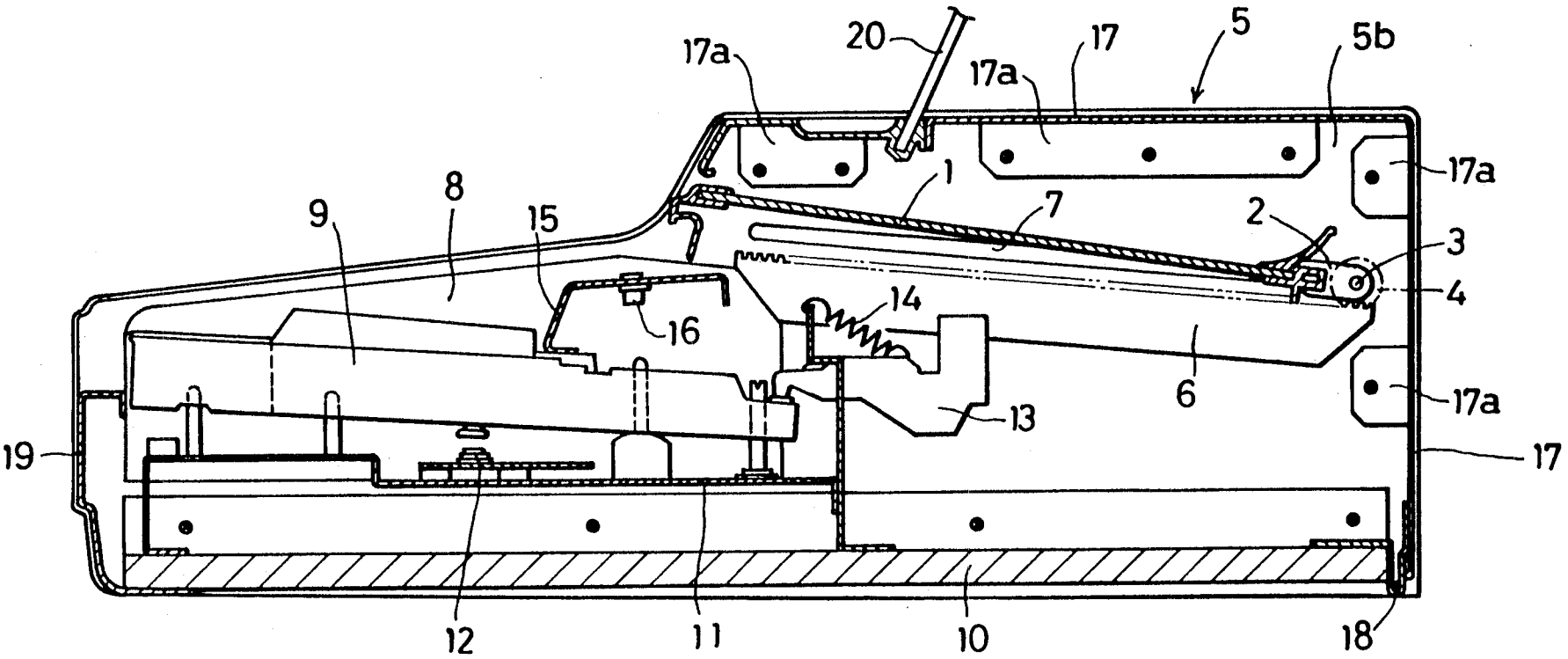
FIG. 2 illustrates a sectional side view of a keyboard-type musical instrument showing the cover open in accordance with the present invention.
Figure 3:
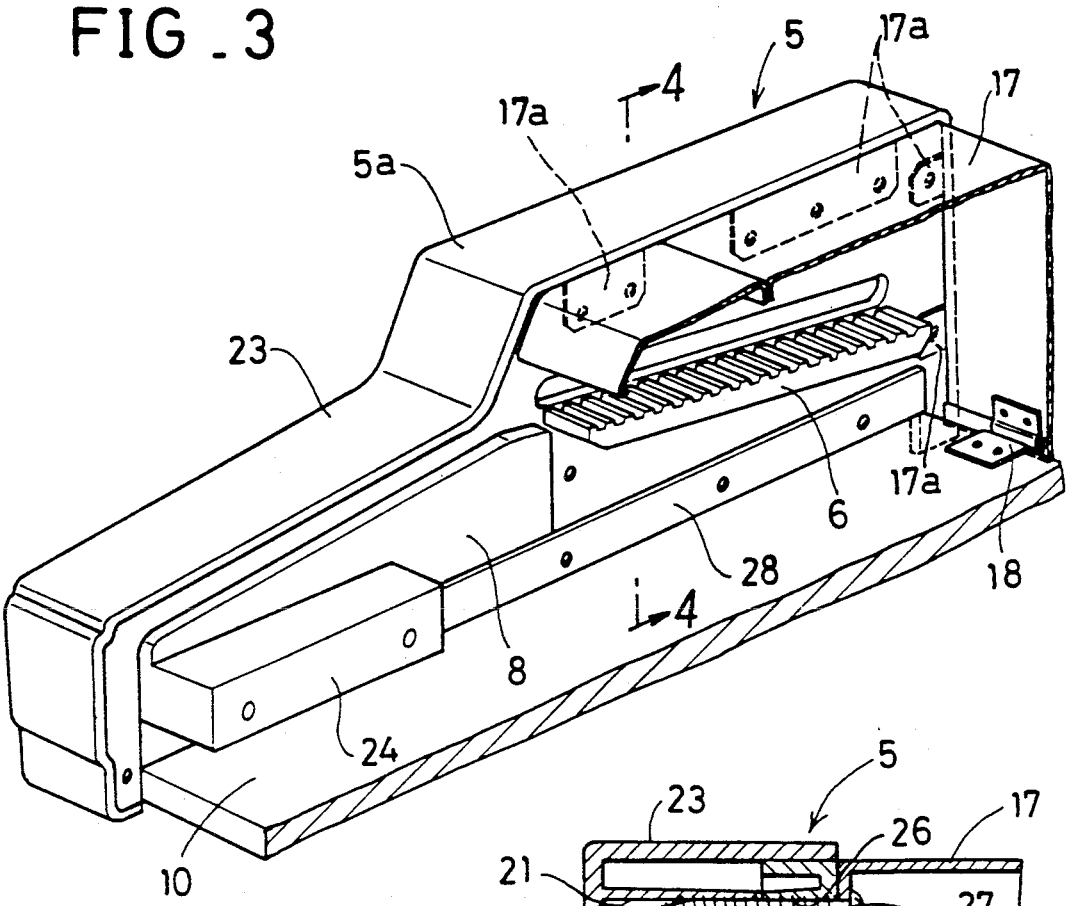
FIG. 3 illustrates a perspective view in accordance with the present invention.
Figure 4:
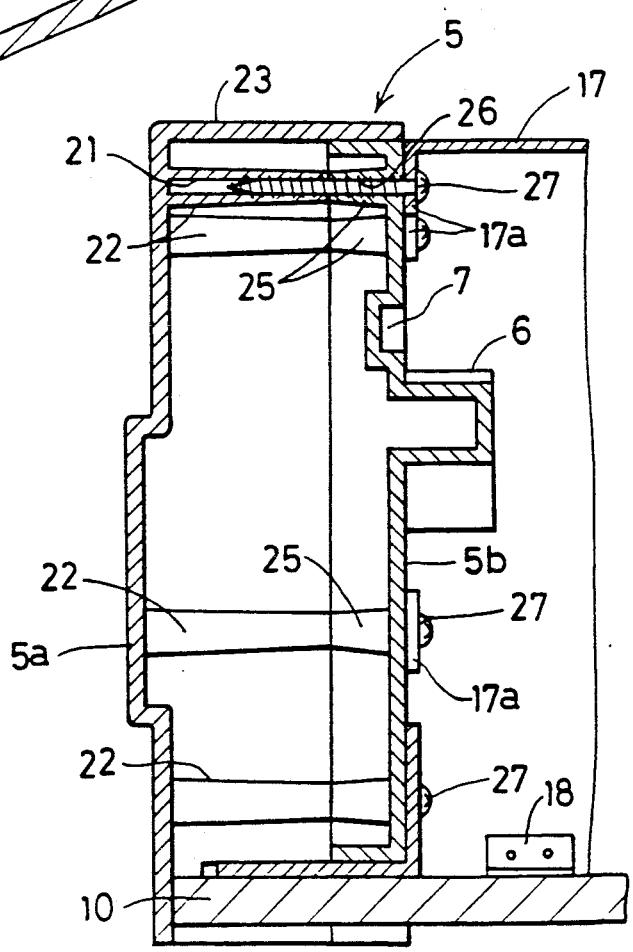
FIG. 4 illustrates a sectional view taken along line 4—4 of FIG. 3.
Figure 5:
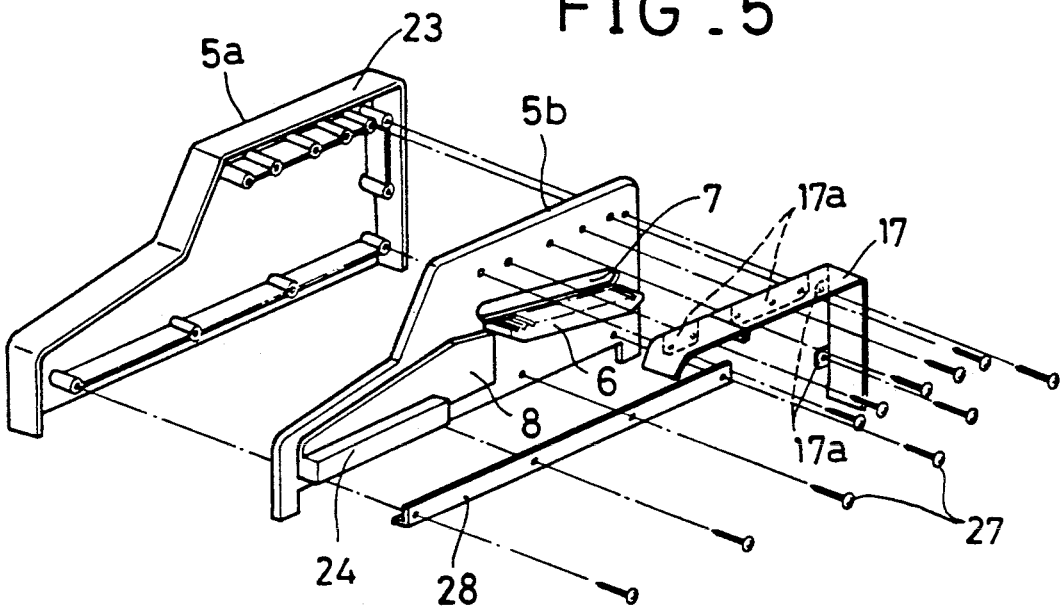
FIG. 5 illustrates an exploded perspective view of a single side-plate in accordance with the present invention.

FIGS. 1 and 2 show sectional side views of an electronic piano which employs an embodiment of the apparatus for opening and closing the sliding cover in accordance with the present invention.

As best seen in FIGS. 1 and 2, numeral 1 denotes the sliding cover. Located at the rear portion of the sliding cover 1, is a rotary shaft 3 supported via a pair of holders 2. At each end of the shaft 3, a pinion 4 is affixed. Each of these pinions 4 comes into engagement with the racks 6 formed on the inner surface of each of the right and left side-plates 5 set in the musical instrument case. The guide members 4*a* of the pinions 4 are slidably fitted into the pinion guide grooves 7 formed on the inner surface of the side-plates 5. The sliding cover 1 thus is slidable along sliding cover guides 8 which are projectingly provided on the inner surfaces of the right and left side-plates 5, from a closed condition as shown in FIG. 1, to an open condition as shown in FIG. 2.

With the musical instrument keys denoted by the numeral 9, the keys 9 are pivotally mounted on a chassis 11 provided on a bottom plate 10. The keyboard switches 12 are actuated by the keys 9 provided on the chassis 11. Pivoting members 13 (members giving resistance to the keys 9) are pivotally supported on the chassis 11 and operate to return the keys to their home (undepressed) position through resilient forces of return spring 14. Control panel 15 includes tone switches 16 and the like. A metallic casing member 17 covers the interior of the musical instrument over the upper and rear surface thereof, each side portion of the casing member being fixed to the inner surfaces of the right and left side-plates 5 at fixing flanges 17*a*. Hinges 18 are mounted between the casing member 17 and the bottom plate 10 such that the bottom plate 10 may be rotated to provide access to the inner part of the musical instrument. Numeral 19 denotes a key slip and numeral 20 denotes a music rack.

The specific construction of the apparatus for opening and closing the sliding cover 1 is best seen in FIGS. 3 through 7. Each side-plate 5 (figures show the side-plate on the left side) comprises a side-plate outer member 5*a* made of resin which is formed into a framed box and a side-plate inner member 5*b* made of resin which is formed into a cover plate to be fitted into the framed box to enclose a space therebetween. As shown best in FIG. 5, the inner side-plate member and the outer side-plate member are substantially coextensive in profile. The side-plate outer member 5*a* has, on its inner side surfaces, projections 22 having screw holes 21 and, on its periphery a flange 23 except for the bottom portion thereof. In a predetermined position on the outer side of the side-plate inner member 5*b*, there are formed a rack 6, the sliding cover guide 8 and a cheek block 24. The pinion guide groove 7 is formed along the rack 6. Projections 25 which contact the projections 22 of the side-plate outer member 5*a* are provided on the inner side surface of the side-plate inner member 5*b*. The side-plate outer member 5*a* and the side-plate inner member 5*b* are connected to each other by bringing projections 22 and 25 into contact with each other and providing screws 27 into screw holes 21 of the projections 22 and screw holes 26 of the projections 22. Best seen in FIGS. 3 through 5, reference numeral 28 indicates the fixing member for the bottom plate 10 being of L-shaped cross section and affixed to the side-plate 5. As also shown in FIGS. 1-5, the screws 27 functions as means for commonly fastening the inner side-plate members 5*b*, the outer side-plate members 5*a* and the metallic casing member 17 all together.

Figure 6:
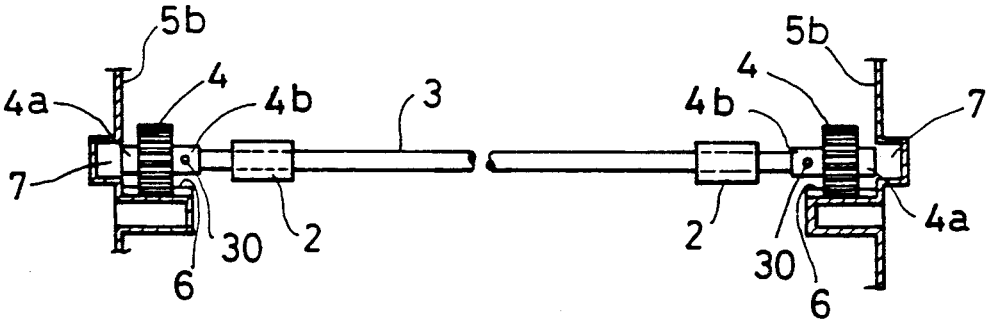
FIG. 6 illustrates a cutaway front view showing the method for mounting the pinion on the sliding cover against the rack in accordance with the present invention.
Figure 7:
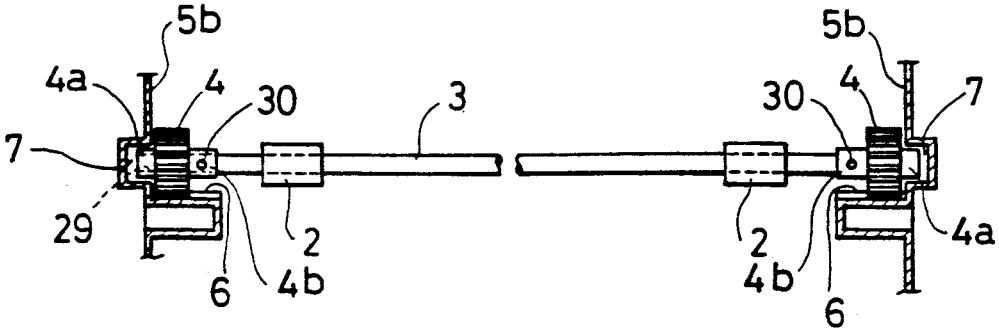
FIG. 7 illustrates a cutaway front view showing the method for mounting the pinion on the cover in accordance with the present invention.
Figure 8:
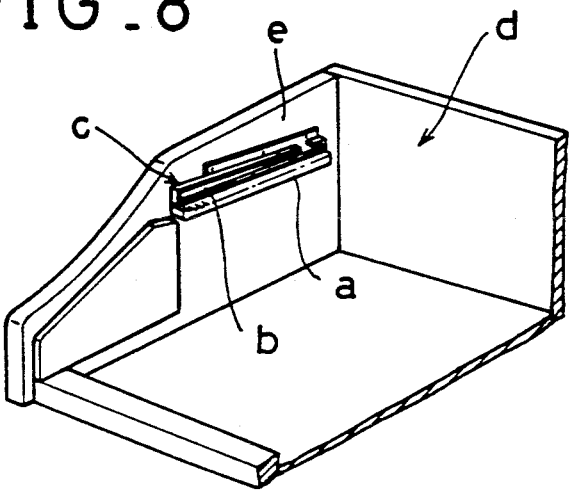
FIG. 8 illustrates a perspective view of a musical instrument case as is well known in the prior art.
Figure 9:
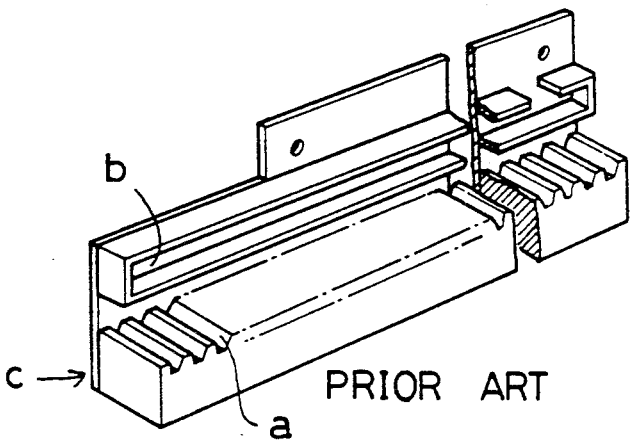
PRIOR ART FIG. 9
FIG. 9 illustrates a perspective view of a member provided with a rack and a guide groove as well known in the prior art.
Figure 10:
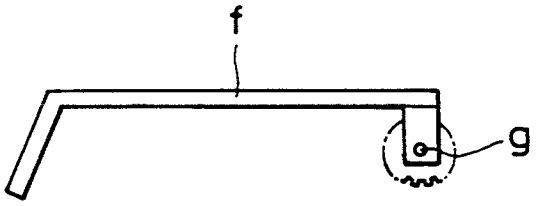
PRIOR ART FIG. 10
FIG. 10 illustrates a side view of the sliding cover shown in FIG. 9 that is well known in the prior art.
Figure 11:
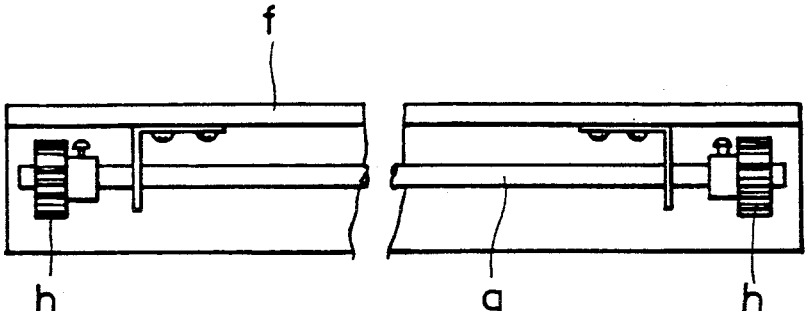
PRIOR ART FIG. 11
FIG. 11 illustrates a rear view of a sliding cover as is well known in the prior art.

Each pinion 4 has an integrally formed guide member 4*a* on one side thereof and a fixing member 4*b* on the other side thereof as best seen in FIGS. 6 and 7. The pinion 4 is fixed at the fixing member 4*b* with a screw 30 to the rotary shaft 3 which is inserted through a hole 29.

When the sliding cover 1, including pinions 4, is mounted to a musical instrument case, the length between the guide members 4*a* of the right and left pinions 4 is made shorter than that between the pair of side-plate inner members 5*b*. This is done by loosening screws 30 on fixing member 4*b*. The pinions 4 are made to engage with the right and left racks 6 as shown in FIG. 6. Then, as shown in FIG. 7, the pinions 4 and the guide members 4*a* are slid outward such that the guide members 4*a* are fitted into the pinion guide grooves 7, the pinions 4 thereafter being fixed with screws 30 to the rotary shaft 3.

A device including the above-mentioned construction would provide a smooth engagement between the racks and the pinions. It has therefore an effect that the sliding cover can be smoothly opened and closed without careful alignment.

Although there has been described what is at present considered to be preferred embodiments of the invention, it will be understood that various modifications and variations may be made therein, and it is intended to cover in the appended claims all such modifications as fall within the true spirit and scope of the invention.

I claim:

1. An apparatus for opening and closing a sliding cover for covering a keyboard of a keyboard musical instrument, comprising:

a right side-plate and a left side-plate, each said side-plate including an outer side-plate member and an inner side-plate member, said inner side-plate member being connected with said outer side-plate member, and said inner and outer side-plate members being substantially coextensive in profile;

each said inner side-plate member having integrally formed thereon a rack and a pinion guide groove;

a rotary shaft provided at the rear end of said sliding cover and having a pinion mounted at the right and left end portions thereof;

said pinions being engaged with said pair of racks formed on said inner side-plate members; and a pair of right and left pinion guide members slidably fitted into said pinion guide grooves.

2. The apparatus according to claim 1, wherein:

said right and left inner side-plate members are connected to each other by means of a casing member.

3. The apparatus according to claim 1, wherein:

each said outer side-plate member is formed into a framed box and each said inner side-plate is formed into a cover plate to be fitted into connection with said framed box so as to enclose a space therebetween.

4. The apparatus according to claim 1, wherein:

said guide members comprise tubular members slidably, adjustably fitted over opposite ends of said rotary shaft, respectively, and said pinions are integrally formed with said tubular members, respectively; and said pinions are slidably mounted in advance on said rotary shaft and are subsequently fixed in positions at which said guide members are engaged with said guide grooves.

5. The apparatus according to claim 1, wherein each said inner side-plate member further has integrally formed thereon a guide for the sliding cover and a cheek block.

6. The apparatus according to claim 2, including means for commonly fastening said inner side-plate members, said outer side-plate members and said casing member all together.

* * * * *